US006854430B2

(12) United States Patent
Olander

(10) Patent No.: US 6,854,430 B2
(45) Date of Patent: Feb. 15, 2005

(54) ENGINE BODY AND CYLINDER FOR INTERNAL COMBUSTION ENGINE

(75) Inventor: Ulf Olander, Huskvarna (SE)

(73) Assignee: Aktiebolaget Electolux, Stockholm (SE)

( * ) Notice: Subject to any disclaimer, the term of this patent is extended or adjusted under 35 U.S.C. 154(b) by 0 days.

(21) Appl. No.: 10/258,092

(22) PCT Filed: Apr. 18, 2001

(86) PCT No.: PCT/SE01/00847

§ 371 (c)(1),
(2), (4) Date: Dec. 27, 2002

(87) PCT Pub. No.: WO01/81748

PCT Pub. Date: Nov. 1, 2001

(65) Prior Publication Data

US 2003/0106507 A1 Jun. 12, 2003

(30) Foreign Application Priority Data

Apr. 20, 2000 (SE) ..... 0001464

(51) Int. Cl.[7] ..... F02B 17/00
(52) U.S. Cl. ..... 123/73 PP; 123/65 A
(58) Field of Search ..... 123/73 PP, 73 R, 123/73 BA, 73 CA

(56) References Cited

U.S. PATENT DOCUMENTS 4,306,522 A 12/1981 Fotsch
4,340,016 A * 7/1982 Ehrlich ..... 123/73 R
4,378,762 A * 4/1983 Ehrlich ..... 123/73 PP
4,802,447 A * 2/1989 Corbett ..... 123/65 R
5,025,760 A * 6/1991 Webb et al. ..... 123/73 PP
5,048,473 A * 9/1991 Curtil ..... 123/65 A
5,090,363 A * 2/1992 Duret ..... 123/73 PP
6,595,168 B2 * 7/2003 Araki ..... 123/73 PP

FOREIGN PATENT DOCUMENTS

GB 2 130 642 A 6/1984

* cited by examiner

*Primary Examiner*—Henry C. Yuen
*Assistant Examiner*—Jason Benton
(74) *Attorney, Agent, or Firm*—Pearne & Gordon LLP

(57) ABSTRACT

The subject invention refers to an engine body for a crankcase scavenged two-stroke engine, comprising a cylinder (1) with a cylinder bore (2), and on opposite sides of the cylinder located, closed scavenging ducts (12*a*, 12*b*), as well as crankcase (10) with at least two crankcase parts, whereby the cylinder (1) and the crankcase (10) are connected to each other in a mutual parting plane (A) essentially perpendicular towards the longitudinal axis (B) of the cylinder bore (2). The engine body is characterized in that said scavenging ducts (12*a*, 12*b*) are having an essentially right-angled bend for, in said parting plane (A), running in a mutual direction around the periphery of the cylinder bore (2), whereby the scavenging ducts (12*a*, 12*b*), in level with the parting plane (A), comprise depressions (21*a*, 21*b*) in at least one of the either the cylinder (1) or the crankcase (10), as well as one connecting duct (14*a*, 14*b*) each, that connect each depression (21*a*, 21*b*) with the inner space of the crankcase (10). Owing to that the scavenging ducts are running in a mutual direction around the periphery of the cylinder bore and are having one connecting duct each to the crankcase, scavenging ducts of such a length are created so that a homogenous air/fuel mixture can be achieved in the scavenging ducts without the crankcase taking too bulky proportions. The length of the scavenging ducts will also allow a satisfactory stratification of the scavenging gases for a two-stroke engine provided with additional air.

14 Claims, 5 Drawing Sheets

ENGINE BODY AND CYLINDER FOR INTERNAL COMBUSTION ENGINE

This application claims the benefit of International Application Number PCT/SE01/00847, which was published in English on Nov. 1, 2001.

TECHNICAL FIELD

The subject invention refers to an engine body for a crankcase-scavenged two-stroke engine, comprising a cylinder having a cylinder bore and closed scavenging ducts located on opposite sides of the cylinder, as well as a crankcase containing at least one crankcase part, whereby the cylinder and the crankcase are connected to each other in a mutual parting plane essentially perpendicular towards the longitudinal axis of the cylinder bore. The invention also relates to a cylinder for such an engine body.

More specifically the invention refers to a die-cast engine body and cylinder.

BACKGROUND OF THE INVENTION

A difficulty regarding crankcase-scavenged engines is to provide a homogeneous air-fuel mixture to the combustion chamber. This can be achieved by so called long scavenging ducts, which however tends to make the crankcase complicated and bulky. For two-stroke engines provided with additional air to the scavenging ducts it is important to keep the air in the-scavenging ducts separated from the air-fuel mixture, in order to as far as possible prevent the air-fuel mixture from the scavenging ducts to disappear out through the exhaust port. This separation, also called stratification, is promoted by making the scavenging ducts long and narrow, thus preventing, or at least reducing, mixing of different scavenging gases.

For an engine body of the above-mentioned kind, where a cylinder is connected to the crankcase in a parting plane essentially perpendicular towards the cylinder bore, usually with a sealing intermediate layer, such as a gasket, the cylinder will end entirely above the crankshaft bearing and is therefore also called "short" cylinder. In order to prolong the scavenging ducts in such engine bodies it is known to let the scavenging ducts turn approximately 90 degrees in level with the contact surface and go round outside the cylinder wall in opposite directions, in order to meet in a mutual connecting duct leading into the crankcase. Since the scavenging ducts are located on essentially diametrically opposed sides of the cylinder each scavenging duct can in this way utilize an extra length corresponding to approximately a quarter of the circumference of the cylinder.

Anyhow, since this cannot always guarantee a satisfactory length of the scavenging ducts it occurs that said connecting duct extends down into the material of the crankcase walls and debouches into the bottom part of the inner space of the crankcase. This however results in a clumsy and bulky crankcase.

The scavenging ducts can be open and are in that case composed of grooves in the cylinder wall, which together with the piston form the scavenging ducts. However, in engines provided with additional air to the scavenging ducts, as well as in conventional, high-performance engines, the scavenging ducts are closed, i.e. they are separated from the cylinder bore by means of an intermediate wall. Usually closed scavenging ducts are vaulted out from the cylinder body for providing the scavenging gases a desired direction into and out from the cylinder bore. This design will lead to difficulties at die-casting of the cylinder body since the direction of the scavenging ducts will vary. Instead chill casting of the cylinder is more common, which is more expensive and more time-consuming.

SUMMARY OF THE INVENTION

The purpose of the subject invention is to achieve a crankcase scavenged two-stroke engine with scavenging ducts of such a length that a homogenous air/fuel mixture can be achieved in the scavenging ducts without the crankcase taking too bulky proportions. The length of the scavenging ducts shall also allow a satisfactory stratification of the scavenging gases for a two-stroke engine provided with additional air.

This purpose is achieved in an engine body of the initially mentioned kind, whereby the scavenging ducts are having an essentially right-angled bend for, in the parting plane between the cylinder and the crankcase, running in a mutual direction around the bottom part of the cylinder bore, whereby the scavenging ducts in level with the parting plane comprise depressions in at least one of the cylinder or the crankcase, as well as connecting ducts that connect each depression respectively with the inner space of the crankcase.

By this design where the scavenging ducts in the parting plane are running in the same direction a greater part of the circumferential length of the cylinder in the parting plane can be used for the length of the scavenging ducts, whereby a satisfactory length of each scavenging duct can be achieved. The connecting ducts connecting the depressions in the cylinder and/or the crankcase with the inner space of the crankcase will not need to run far down into the crankcase, as the scavenging ducts already have a sufficient length. Nor there is need for two scavenging ducts to meet in only one connecting duct in the way described above, which should have created a disadvantageous turbulence. Furthermore, both connecting ducts will contribute to the total length of the scavenging ducts.

It should be observed that even if there are two scavenging ducts in the parting plane, each one of them could over at least some part of their extension be divided into further ducts, e.g. by means of an intermediate wall be divided into two ducts on each side, i.e. totally four ducts. According to prior art this exists to achieve a satisfactory direction of scavenging gases through the scavenging ports.

Each scavenging duct runs along more than a quarter or preferably along more than a third of the periphery of the cylinder, and preferably along almost half the periphery, for, to as great extent as possible, utilizing the parting plane.

It is especially preferred to let said connecting ducts debouche into the crankcase immediately below the parting plane. Thereby the size of the crankcase will be reduced as much as possible.

According to an embodiment the scavenging ducts over at least some part of their length above the parting plane are parallel with the cylinder bore. Owing to this design of the scavenging ducts, die-casting of the cylinder will be simplified, and this is also the preferred way of manufacturing. An exterior covering element could then, after the die-casting process, be arranged at the upper part of each scavenging duct for creating the exterior part of a transition between the, with the cylinder bore, parallel part of the scavenging duct and a through the cylinder wall running scavenging port. This covering element is thus creating a bent exterior wall of the scavenging duct in order to reduce the flow resistance at the transition between the scavenging port and the, with the cylinder bore, parallel part of the scavenging duct.

Said depressions which represent a part of the scavenging ducts can according to an embodiment only be arranged either in the cylinder or the crankcase. Consequently, owing to that the extension of the scavenging ducts in the parting plane is solely arranged either in the cylinder or the crankcase of the engine body the manufacturing can be even more simplified Also observe that even if the depressions should be arranged entirely in the crankcase, the scavenging ducts will already in the cylinder show such a design, that it enables the bending in the parting plane without resulting in a too large flow resistance.

Particularly, said depressions can be arranged in the cylinder, which in that case must be designed with a bottom flange whose material should be able to surround the depressions. According to this embodiment it is thus only the connecting ducts that are arranged in the crankcase, and possibly these could also be arranged in the cylinder. In case the depressions are arranged only in the cylinder, a shaping element could preferably be arranged in each depression for providing the scavenging ducts a desired cross-sectional form. Such a shaping element can be especially preferable in the corner where the scavenging duct's, with the cylinder bore, parallel part passes over in the horizontal depression, i.e. in the one end of the depression. For, in the die-casting process it will hereby of necessity be created an essentially right angle, which runs the risk of affecting the flow pattern of the scavenging ducts in a negative way.

According to an embodiment of the invention the depressions are arranged both in the cylinder and the crankcase, and a disc-shaped element provided with penetrating apertures is arranged in the parting plane. The apertures connect one end of each depression in the cylinder with one end of the corresponding depression in the crankcase, so that each scavenging duct runs along the periphery of the cylinder bore in a depression in the cylinder, and thereafter, via an appropriate aperture in the disc-shaped element, continues to run in the same direction along the periphery of the cylinder bore, in the corresponding depression in the crankcase.

By this design the scavenging ducts can be forced to overlap each other, and each scavenging duct can be designed to extend more than half a turn around the periphery of the cylinder. This is advantageous when very long scavenging ducts are required, and according to the invention this can be achieved relatively easy.

According to a preferred embodiment of the invention the cylinder has, besides an inlet for air/fuel mixture, also at least one inlet for additional air to the combustion chamber, which inlet for additional air runs through the cylinder wall and via recesses in the piston extends down into the scavenging ducts. The engine body is according to this embodiment arranged for providing additional air through said inlet into the scavenging ducts during the movement of the piston close to the top dead center. As mentioned above the length of the scavenging ducts is particularly important for engines of this kind, since it is important to keep the additional air separated from the air/fuel mixture in the scavenging ducts. The subject invention thus enables an improvement of this function owing to the longer scavenging ducts.

The invention also refers to a cylinder intended to be part of an engine body of the initially mentioned kind, whereby said scavenging ducts have an essentially right-angled bend for, in said parting plane, running in a mutual direction around the periphery of the cylinder bore, along depressions that are arranged in the parting plane.

BRIEF DESCRIPTION OF THE DRAWINGS

The invention will be described in the following with reference to the accompanying drawing figures, which in the purpose of exemplifying are showing preferred embodiments of the invention.

DETAILED DESCRIPTION OF PREFERRED EMBODIMENTS

Figure 1:
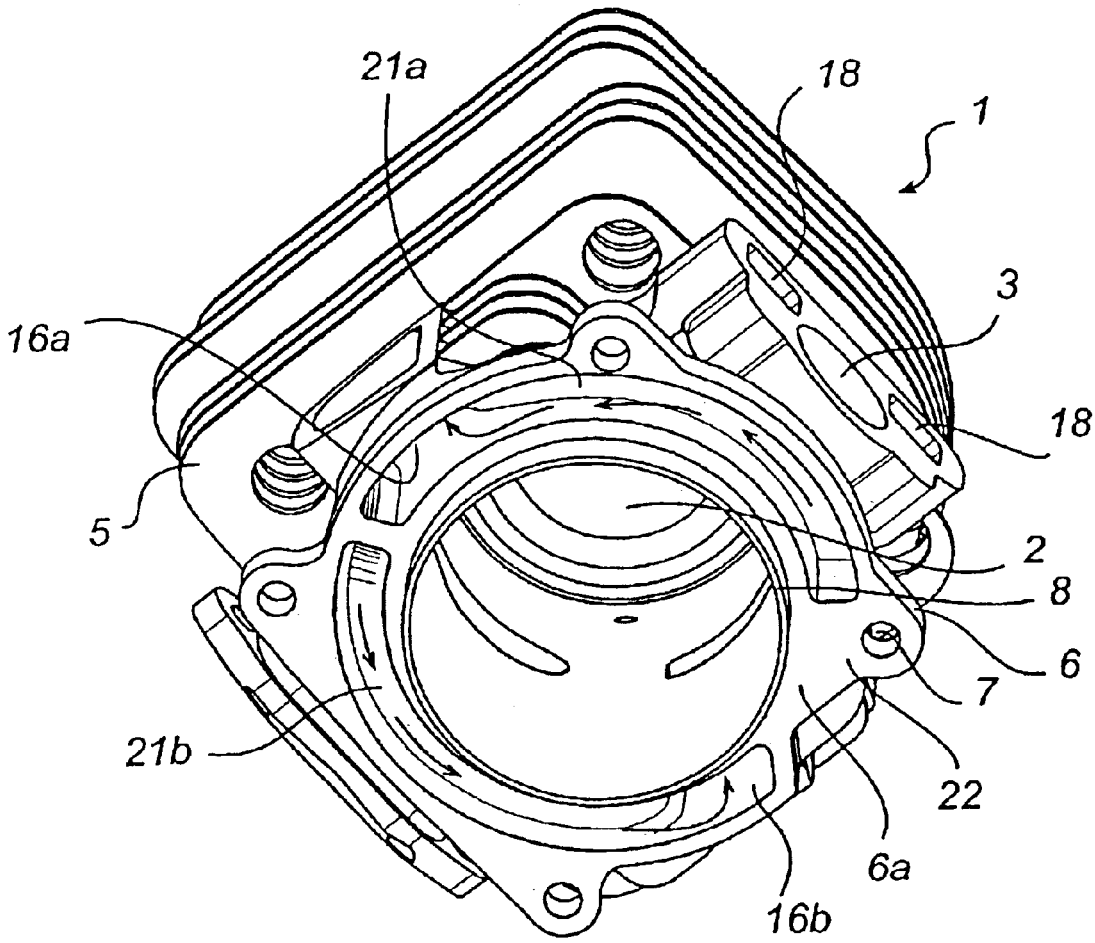
FIG. 1 illustrates in perspective, obliquely from below, a cylinder according to a first embodiment of the invention.

With reference to FIG. 1 a cylinder according to a first embodiment of the invention is shown. The cylinder has a cylinder bore 2, in which a piston (not shown) is intended to be movable, an inlet 3 for air/fuel mixture adapted for connection to a carburettor via an inlet tube (not shown), as well as an exhaust outlet (hidden in the figure) adapted for connection to a muffler. The entire cylinder is surrounded by cooling fins 5, and at its lower edge a stronger flange 6 is arranged and intended, by means of attachment devices, such as bolts running through recesses 7, to be firmly connected to a crankcase. The underside 6*a* of the flange, which will be described in closer detail in the following, is located in an imagined parting plane A between the cylinder 1 and a at the cylinder firmly connected crankcase 10, consisting of two halves, as shown schematically in FIG. 2. The cylinder bore 2 continues a bit below the flange in that a collar 8 extends pass by the underside 6*a* of the flange 6. This collar 8 serves as guidance of the cylinder bore 2 in relation to the crankcase 10. In the parting plane A usually a gasket (not shown) of some kind is arranged, for sealing between cylinder 1 and crankcase 10.

The cylinder comprises two, on each side of the inlet located scavenging ducts 12*a*, 12*b*. The scavenging ducts 12*a*, 12*b* connect in the conventional way scavenging ports in the cylinder wall with scavenging openings in connection to the crankcase 10.

Furthermore the cylinder 1 has two, obliquely above the inlet 3 located inlets 18 for additional air. These inlets 18 are in a known way arranged via recesses in the piston to be connected to the scavenging ports 13*a*, 13*b* when the piston is located close to its top dead center. In this position additional air can be supplied into the scavenging ducts 12*a*, 12*b* in order to prevent the air/fuel mixture from the scavenging ducts to follow, together with exhaust gases, out through the exhaust outlet.

Figure 2:
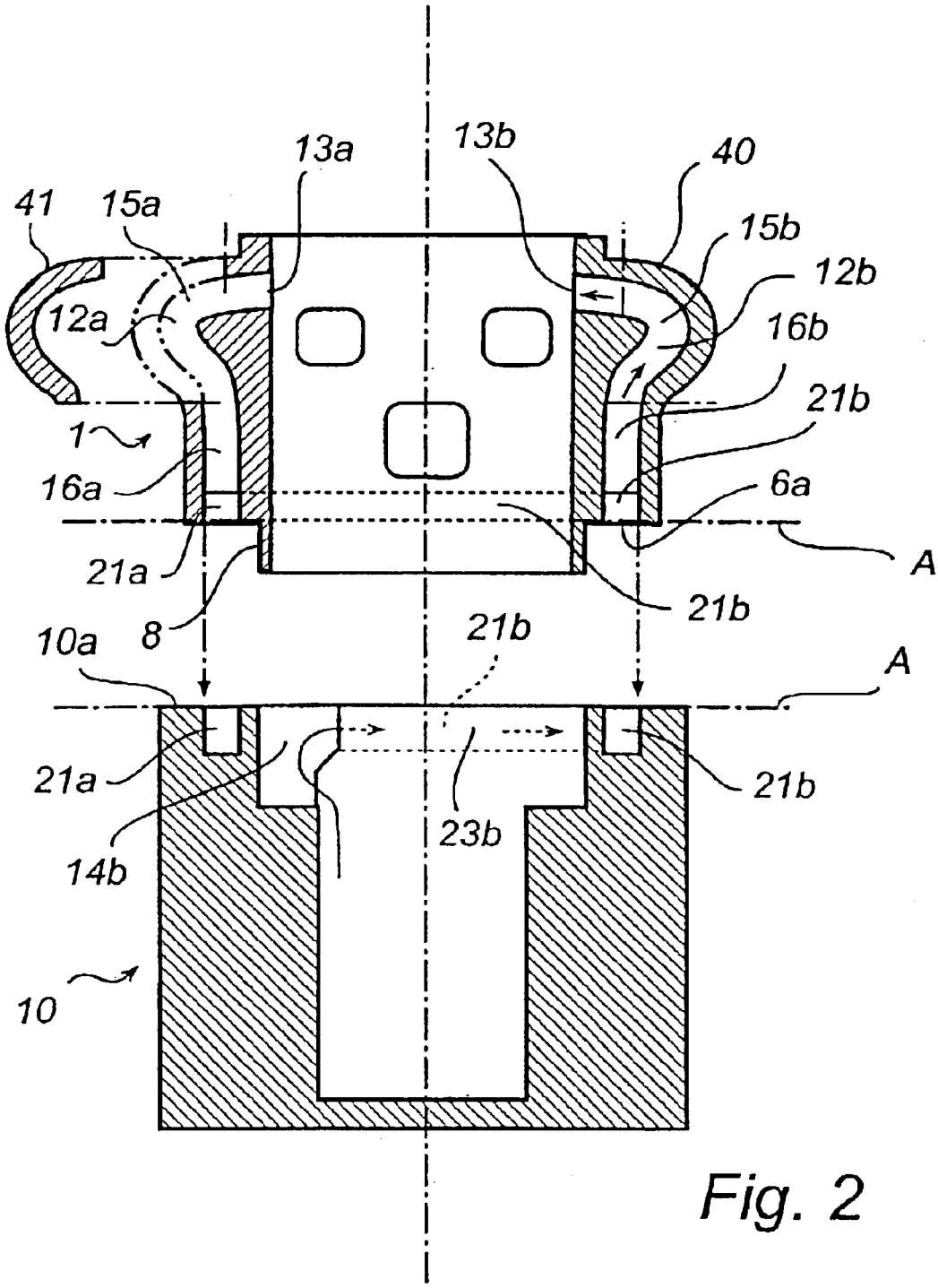
FIG. 2 illustrates schematically a cross-sectional view of the cylinder according to FIG. 1, connected to a crankcase.

FIG. 2 schematically and in an exploded cross-sectional view shows a cylinder 1 according to the invention and a crankcase 10. In the cylinder 1 the scavenging ports 13*a*, 13*b* become apparent as well as the scavenging ducts 12*a*, 12*b* which debouche through these. From the essentially diametrically opposed scavenging ports 13*a*, 13*b* each scavenging duct runs relatively radially out from the cylinder bore, possibly with the mouth in the cylinder bore directed somewhat away from the exhaust outlet in the conventional way. After a bent section 15*a*, 15*b*, a section 16*a*, 16*b* of the scavenging duct will then run in parallel with the cylinder bore 2, and then bend off in order to, in the parting plane A, run along the periphery of the cylinder bore. In the parting plane A the scavenging ducts 12*a*, 12*b* in the shown case are composed of depressions 21*a*, 21*b*, either in the cylinder 1 or the crankcase 10, and ends up with connecting ducts 14*a*, 14*b*, which lead into the inner space of the crankcase 10. Depending on the cross-sectional view in FIG. 2 only the one scavenging opening 14*b*, which via scavenging duct 12*b* is connected with scavenging port 13*b*, is shown. The depression 21*b* is separated from the inner space of the crankcase 10 by means of an inner partition wall 23*b*, and said connecting ducts are in the simplest case just composed of apertures in this partition wall.

Again, with reference to FIG. 1, is shown how the scavenging ducts 12*a*, 12*b* vertical sections 16*a*, 16*b* will bend off in order to, in level with the parting plane A, run along the periphery of the cylinder bore 2 in the depressions 21*a*, 21*b* in the flange 6. Owing to that the depressions 21*a*, 21*b* are running in a mutual direction, i.e. either clockwise or counter-clockwise, around the cylinder bore, the entire material of the flange 6 can be used at maximum. Owing to that the vertical sections 16*a*, 16*b* of the scavenging ducts 12*a*, 12*b* in the shown example are not located exactly opposite each other, the one depression 21*a* could in principle extend a bit longer than the other one, before it reaches up to the other depression 21*b*. However, in the shown example both depressions 21*a*, 21*b* are made equally long, why one part 22 of the flange 6 will remain unused.

Figure 3:
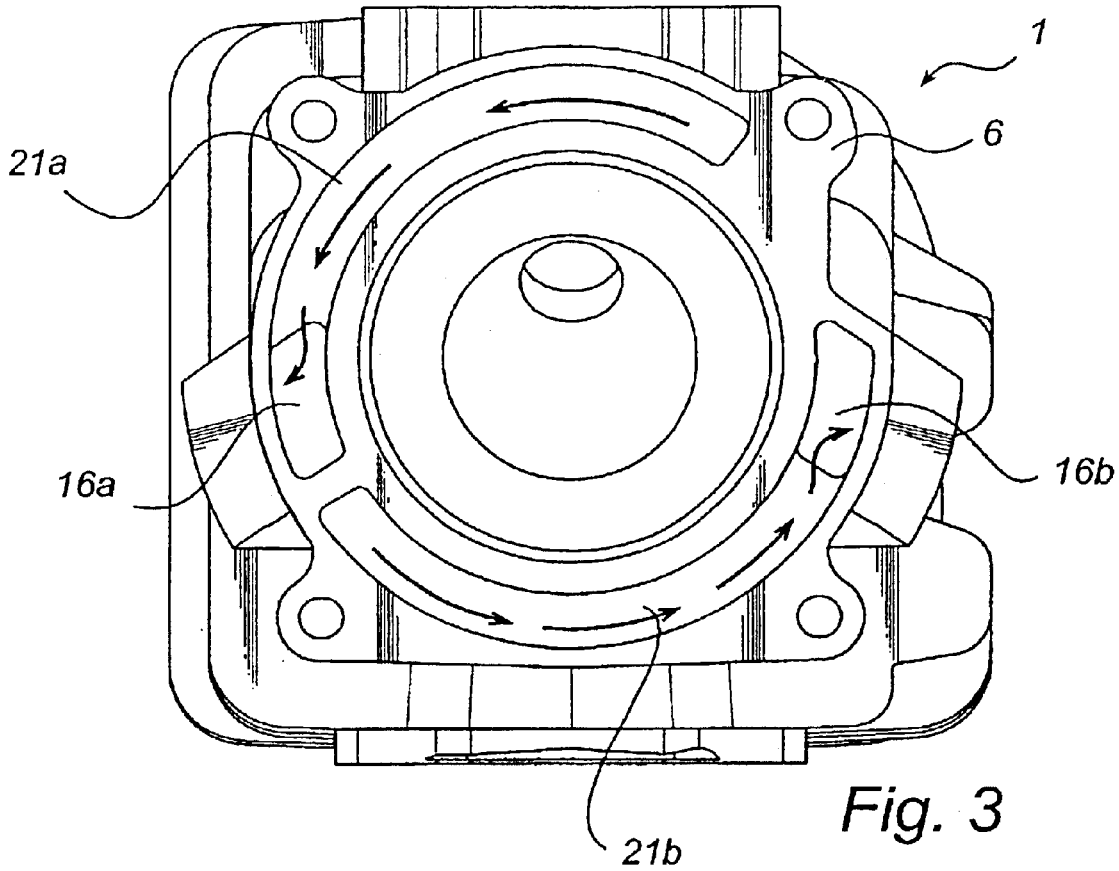
FIG. 3 shows a plane view from below of the cylinder according to the FIGS. 1 and 2.
Figure 4:
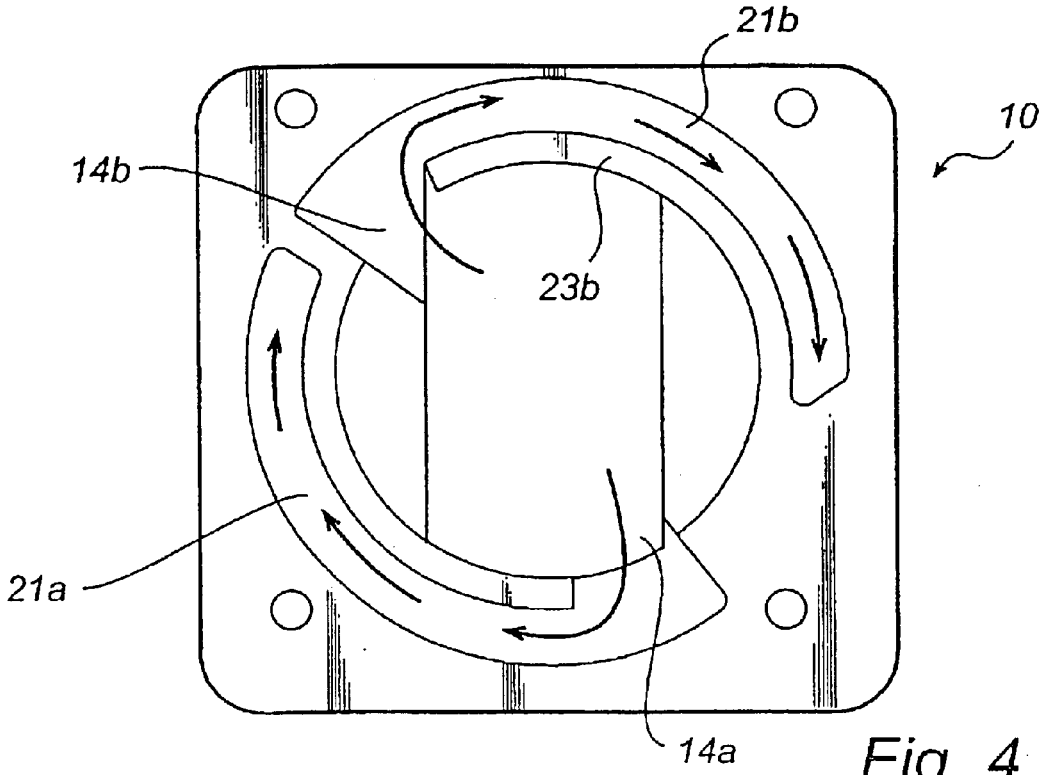
FIG. 4 shows a plane view from above of the crankcase according to FIG. 2.
Figure 5A:
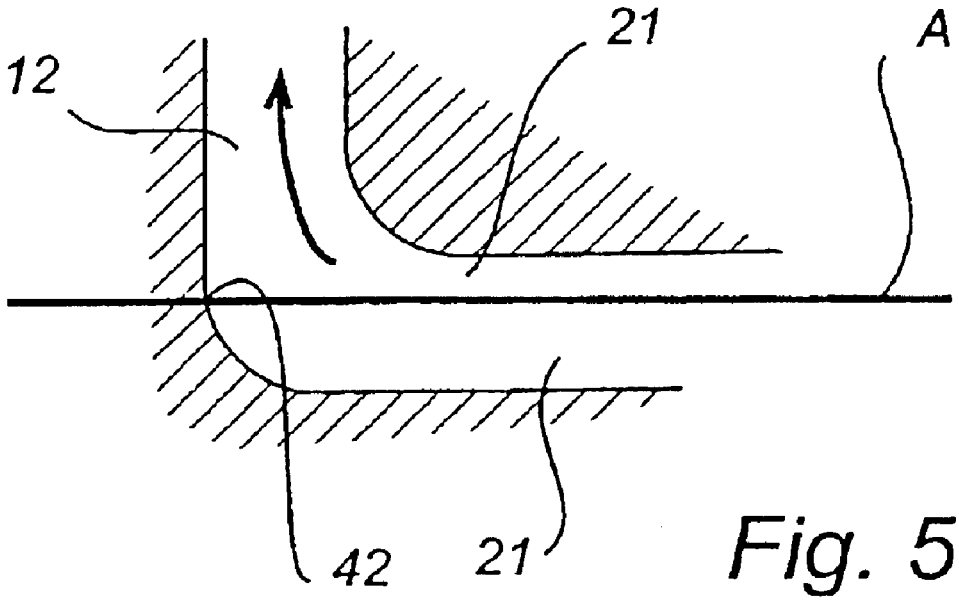
FIG. 5*a* shows the design of the scavenging ducts in the parting plane between the cylinder and the crankcase according to the first embodiment of the invention.
Figure 5B:
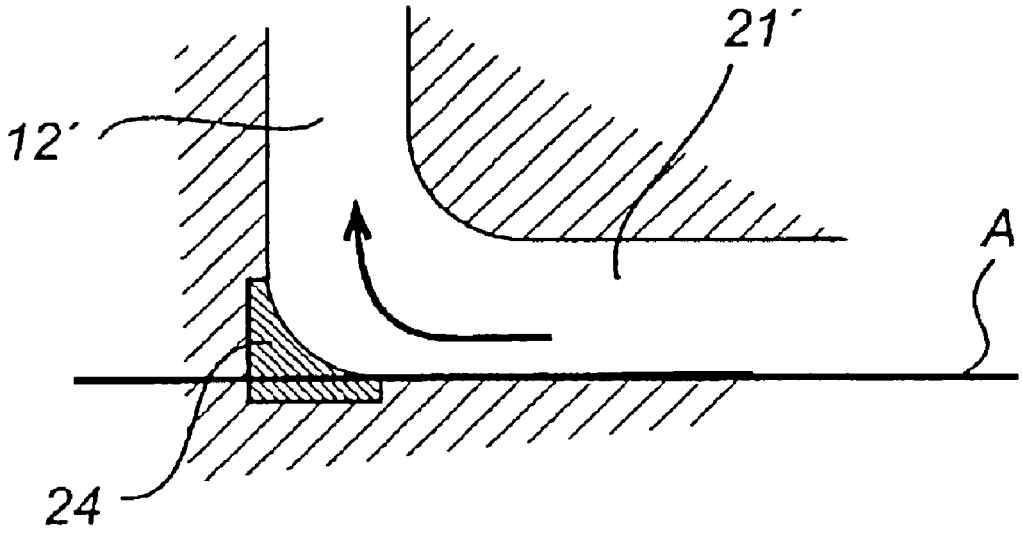
FIG. 5*b* corresponds to FIG. 5*a* according to a second embodiment of the invention.

FIGS. 3 and 4 clearly show how the depressions 21*a*, 21*b* are arranged, both in the cylinder 1 and in the crankcase 10, in order to together form the peripherally running parts of the scavenging ducts 12*a*, 12*b*. Obviously, it would be possible to only arrange the depressions 21*a*, 21*b*, either in the cylinder or in the crankcase, in case this should be recommended by the skilled man. In FIGS. 5*a* and 5*b* is shown, in a cross-sectional view from the side, a part of the parting plane A between cylinder and crankcase, more precisely the part where the vertical section of the scavenging duct 12 passes over into a peripherally running section. In FIG. 5*a*, as well as in FIGS. 3–4, the depressions are arranged both in the cylinder's 1 flange 6 and in the material of the crankcase 10. The scavenging duct 12 extends thus both above and below the parting plane. In FIG. 5*b*, on the other hand, the depressions 21' are only arranged in the cylinder 1, whereby the crankcase 10 only serves as the lower limit of the scavenging duct 12'. A shaping element, such as an insert piece 24, is hereby inserted in the one end of the depression, and creates the outer wall of the essentially 90° bend of the scavenging duct. The reason for this will be described in the following, with reference to how the cylinder is manufactured.

Figure 6:
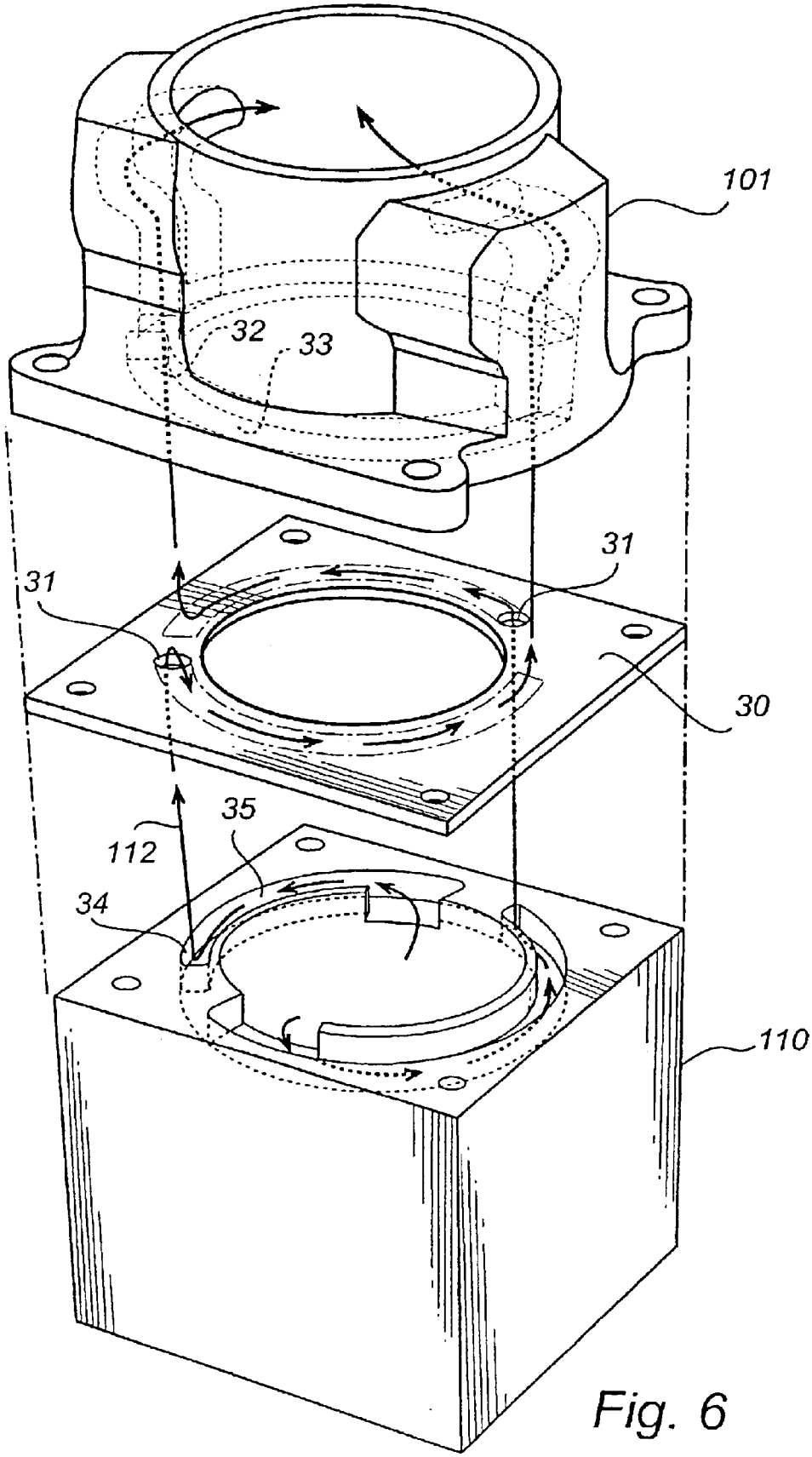
FIG. 6 illustrates schematically a cross-sectional view of a cylinder according to a second embodiment of the invention, connected to a crankcase.

According to a second embodiment of the invention as shown in FIG. 6, a disc-shaped intermediate element 30 with penetrating apertures 31, is arranged in the parting plane A between cylinder 101 and crankcase 110. According to this embodiment depressions are arranged both in the cylinder 101 and in the crankcase 110, and they are formed in such a way that beginning 32 of a depression 33 in the cylinder 101 is arranged essentially above the end 34 of corresponding depression 35 in the crankcase 110. An aperture 31 connects the depression 33 in the cylinder 101 with the depression 35 in the crankcase 110, whereby each scavenging duct 112 extends first along a depression 35 in the crankcase 110, and then passes through the aperture 31 in the disc 30, in order to then continue in the same direction along a depression 33 in the cylinder 101. In other words, the scavenging duct 112 runs in a way like a spiral, where the disc 30 serves as a partition wall in the spiral.

The manufacturing of the cylinder 1 according to the invention preferably takes place by die-casting. The first, essentially horizontal section, of the scavenging duct can hereby be formed by means of a first set of slides, arranged to be readable radially out from the center axis of the cylinder. The second, essentially vertical sections 16*a*, 16*b*, can in the corresponding way be formed by means of a second set of slides, arranged to be movable in the longitudinal direction of the cylinder. However, at die-casting of a cylinder, as shown in FIG. 2, the bent section 15*a*, 15*b* of the scavenging ducts cannot be formed during the die-casting process. The outer wall 40 of this bent section is thus composed of a covering element in form of a cover 41, which connects the essentially horizontal section of the scavenging duct with its vertical section 16*a*, 16*b*.

The above-mentioned second set of slides will be pulled out from the cylinder through the underside 6*a*. On the one side of each slide runs the depression 21*a*, 21*b*, whose inner side is formed in order to gradually pass over into the vertical section 16*a*, 16*b*, but on the other side of the slide there is solid material, whereby a sharp edge 42 is created. In case the depressions should be arranged only in the cylinder 1, i.e. not in the crankcase 10, this sharp edge 42 will be created in the outer wall of the scavenging duct, exactly in the corner where the vertical section 16*a*, 16*b* of the scavenging duct will meet the upper side 10*a* of the crankcase and then pass over into the depression 21*a*, 21*b*. In order to eliminate this sharp edge 42, and to achieve a more advantageous flow in the scavenging duct, preferably an insert piece 24 will be inserted in this comer, in the way as illustrated in FIG. 5*b*.

It is obvious that a number of variations are conceivable within the scope of the appended patent claims, and that the above-mentioned descriptions of preferred embodiments should only be regarded as examples. E.g. the design of the scavenging ducts along the cylinder wall can be varied in many different ways, and also the cylinder and the crankcase can vary regarding geometry and fit. The above described arrangement for supply of additional air down into the scavenging ducts can also be arranged in different ways.

What is claimed is:

1. An engine body for a crankcase scavenged two-stroke engine, comprising:

a cylinder (1) with a cylinder bore (2) that has a longitudinal axis;

a crankcase (10); and two scavenging ducts (12*a*, 12*b*) arranged to port into opposite sides of the cylinder (1) and extending between the crankcase (10) and the cylinder bore (2);

wherein the cylinder (1) and the crankcase (10) are separate components, with a separation between the cylinder (1) and the crankcase (10) located essentially at a mutual parting plane (A) that extends perpendicular to the longitudinal axis of the cylinder bore (2), the scavenging ducts (12*a*, 12*b*) each have portions that are provided by depressions (21*a*, 21*b*) in at least one of either the cylinder (1) or the crankcase (10) that at are open on one side at the parting plane (A), each of the depressions (21*a*, 21*b*) extends in the parting plane (A) around the periphery of the cylinder bore (2), the scavenging ducts (12*a*, 12*b*) each have connecting ducts (14*a*, 14*b*) that connect the respective depressions (21*a*, 21*b*) to an inner space of the crankcase (10)

adjacent to the parting plane (A), the depressions provide for a right-angle turn for flow proceeding from the connecting ducts (14*a,* 14*b*) to the respective depressions (21*a,* 21*b*), and the turn at each depressions (21*a,* 21*b*) is in the same direction.

2. An engine body according to claim 1, wherein each scavenging duct (12*a,* 12*b*) extends along more than a quarter of the periphery of the cylinder (1) within the parting plane (A).

3. An engine body according to claim 1, wherein the connecting ducts (14*a,* 14*b*) are located immediately below the parting plane (A).

4. An engine body according to claim 1, wherein the scavenging ducts (12*a,* 12*b*) include parts (16*a,* 16*b*) that are located above the parting plane (A) and that extend parallel with the cylinder bore (2).

5. An engine body according to claim 1, wherein the cylinder (1) is die-cast.

6. An engine body according to claim 5, wherein the scavenging ducts (12*a,* 12*b*) include an upper section (15*a,* 15*b*) and separate outer covers (41) arranged at the upper sections (15*a,* 15*b*).

7. An engine body according to claim 1, wherein the depressions (21*a,* 21*b*) only are arranged in either the cylinder (1) or the crankcase (10).

8. An engine body according to claim 7, wherein the depressions (21*a,* 21*b*) are arranged in the cylinder (1).

9. An engine body according to claim 7, wherein a separate shaping element (24) is arranged in each depression (21*a,* 21*b*), in order to provide a desired cross-sectional shape.

10. An engine body according claim 1, wherein the depressions (21*a,* 21*b*) are arranged in both the cylinder (1) and the crankcase (10), and wherein a disc shaped element (30), which includes penetrating apertures (31), is arranged in the parting plane (A), the apertures (31) connect one end of each depression (33) in the cylinder with one end of corresponding depression (35) in the crankcase, so that each scavenging duct (12) runs along the periphery of the cylinder bore (2) in a depression (33) in the cylinder, and thereafter, via the aperture(31) in the disc-shaped element, continues to run in the same direction along the periphery of the cylinder bore in the corresponding depression(35) in the crankcase (10).

11. An engine body according to claim 1, whereby the cylinder, besides an inlet (3) for air/fuel mixture, is provided with at least one inlet (18) for additional air to the combustion chamber, which inlet for additional air runs through the cylinder wall and via recesses in the piston leads down into the scavenging ducts (12*a,* 12*b*).

12. A cylinder (1) for a crankcase scavenged two-stroke engine, the cylinder including:

a cylinder bore (2) that has an underside (6*a*) intended to be connected to a crankcase (10) at a parting plane (A); and closed scavenging ducts (12*a,* 12*b*) located on opposite sides of the cylinder:

wherein the scavenging ducts (12*a,* 12*b*) each have portions that are provided by depressions (21*a,* 21*b*) that extend in the parting plane (A) around the periphery of the cylinder bore (2), the depressions provide for a right-angle turn for flow proceeding into the depressions (21*a,* 21*b*), and the turn at each depressions (21*a,* 21*b*) is in the same direction.

13. A cylinder according to claim 12, wherein the depressions (21*a,* 21*b*) are arranged in the material of the cylinder (1).

14. A cylinder according to claim 12, wherein the scavenging ducts (12*a,* 12*b*) over at least a part of their length above the parting plane (A) are parallel with the cylinder bore (2).

* * * * *